US005291819A

United States Patent [19]

Hambric

[11] Patent Number: 5,291,819

[45] Date of Patent: Mar. 8, 1994

[54] BATTLEFIELD DEBRIS CLEARING APPARATUS

[76] Inventor: Harry N. Hambric, 5350 Wade La., Woodbridge, Va. 22192

[21] Appl. No.: 953,111

[22] Filed: Sep. 29, 1992

[51] Int. Cl.[5] ..... F41H 11/16; E02F 3/76

[52] U.S. Cl. ..... 89/1.13; 37/405; 171/141; 171/144

[58] Field of Search ..... 171/141, 144, 10, 11, 171/23, 46, 47, 63, 82; 89/1.13; 37/106, 107, 117.5

[56] References Cited

U.S. PATENT DOCUMENTS

| | | | |
|---|---|---|---|
| 367,554 | 8/1887 | Shailer et al. | 37/107 |
| 701,593 | 6/1902 | Mahoney | 37/106 |
| 1,264,289 | 4/1918 | Finney | 89/1.13 |
| 1,472,300 | 12/1923 | Jannelle | 171/144 |
| 2,146,101 | 2/1937 | Weber | 89/1.13 |
| 3,316,666 | 5/1967 | Speno | 37/107 |
| 4,021,725 | 5/1977 | Kirkland | 89/1.13 |
| 4,467,694 | 8/1984 | Azulai et al. | 89/1.13 |
| 4,491,053 | 1/1985 | Bar-Nefy et al. | 89/1.13 |
| 4,552,053 | 11/1985 | Bar-Nefy et al. | 89/1.13 |
| 4,590,844 | 5/1986 | Bar-Nefy et al. | 89/1.13 |
| 4,593,766 | 6/1986 | Gossard | 89/1.13 |
| 4,690,030 | 9/1987 | Bar-Nefy et al. | 89/1.13 |
| 4,840,105 | 6/1989 | Ladan et al. | 89/1.13 |
| 4,967,850 | 11/1990 | Bargfrede et al. | 89/1.13 |
| 5,029,649 | 7/1991 | Kershaw et al. | 37/107 |
| 5,141,058 | 8/1992 | Heppner | 171/63 |

*Primary Examiner*—David H. Brown
*Attorney, Agent, or Firm*—Richard C. Litman

[57] ABSTRACT

A battlefield debris clearing apparatus for attachment to a vehicle comprising a horizontal beam for lateral attachment to a vehicle; a plurality of baskets pivotally attached to the beam, each basket having an opening to lift and collect battlefield debris from the ground surface; and a mechanism for the rotation of the baskets about an axis substantially parallel to the longitudinal axis of the beam. Apparatus is provided for the delivery of a high velocity gas stream to the ground surface proximate the baskets. A magnetic sensor array positioned behind the baskets detects objects deeply buried below the ground surface.

19 Claims, 3 Drawing Sheets

BATTLEFIELD DEBRIS CLEARING APPARATUS

FIELD OF THE INVENTION

The present invention relates to explosive mine destroying and collecting devices employed in wartime activities. In particular, it relates to an apparatus mountable upon a bulldozer, tank, or other armored vehicle for destroying unexploded ordinance as well as collecting the resultant subordinance and other battlefield debris.

BACKGROUND OF THE INVENTION

In a village in southeastern Turkey recently, a vehicle transporting individuals to work struck a land mine. Five people were killed and another ten were injured. A few weeks before, in Azerbaijan, a bus ran over a mine killing fourteen. Before that, in Croatia, two nurses suffered severe injury when their truck rolled over a mine while evacuating the wounded from a battle.

International statistics on deaths caused by land mines are not kept. It has been estimated, however, that sixty Cambodians per month die or lose limbs. In the fourteen-year Afghanistan war approximately two hundred thousand people, primarily civilians, died as a result of mine explosions. An additional four hundred thousand were injured. Mines laid more than a quarter of a century ago by U.S. soldiers still injure Vietnamese and Laotians periodically.

In addition to U.S. firms, thirty-five countries around the world host companies which produce explosive land mines. Spain, Italy, and Greece produce the SB-33 antipersonnel mine, a light-weight explosive that can be strewn from the air or individually buried. The former Soviet Union produced a somewhat larger mine that when activated by the foot, or other pressure, jumps five to eight feet above the ground surface and sends shrapnel into people's bodies. Those in the trade refer to these mines as "Bouncing Bettys."

A decade ago, the United States signed a United Nations protocol prohibiting or restricting the use of certain conventional weapons including land mines. Unfortunately, the Senate has failed to ratify the protocol and the Executive Branch has not pressed the matter. Land mines continue to be manufactured in the U.S. and elsewhere.

It can be argued that land mines serve an essential military purpose during times of war. Such mines neutralize an opponent's ground support capabilities. These devices, buried below the ground's surface avoiding ready detection, explode violently when triggered. The explosive force of some mines is so great that a heavily armored and fortified tank may be destroyed. In this way enemy movement is hampered or altogether halted.

It is essential once wartime activities cease, that mines be cleared from the field to prevent civilian casualties. Various systems have been developed to detect and remove land mines, most are directed toward shunting aside mines to permit troop and vehicular movement during time of war. One such system utilizes a plow mounted on the front of a tank and driven through the soil to expose and sweep aside mines. These mine plows have been effective when combined with powerful, heavy tanks since their power and tractive ability easily propel the plow through roots, clay, or uneven terrain.

The standard mine plow has two separate blades for cutting the earth and exposing mines. These blades are generally oriented in V-shaped fashion at the front of a tank or other vehicle. When driven forward through the ground surface, two earthen berms are formed of spoil material pushed tangentially along the blades away from the path of the vehicle. The spoil material often contains mines and other unexploded ordinance which did not detonate upon contact with the plow.

While V-shaped blades provide adequate protection for a single vehicle so equipped, they are impractical for clearing large areas of mines and jagged metal shrapnel. In clearing large areas, the plow is usually systematically moved in parallel paths across the entirety of the target area. Without overlapping the paths by a minimum of one half of the V-shaped blades' overall width, one can not be assured that the area being cleared is indeed free of mines. Such an overlap prevents previously exposed berm material from being plowed back into the previously cleared area. Due to the inefficiency of the currently available mine clearing devices in eliminating mines from large areas, a need has arisen for a more efficient device.

DESCRIPTION OF THE RELATED ART

Attempts have been made to overcome some of the deficiencies associated with prior art plows. Nonetheless, most of the development in the art has been concentrated upon improving plows with deficient V-shaped blades. None of these devices is capable of gathering up, storing, and discharging ordinance and subordinance in a controlled fashion.

U.S. Pat. No. 1,264,289, issued Apr. 30, 1918 to George E. Finney, shows a derrick for supporting a plow upon the front of a tractor in such a manner so as to permit the plow and supporting frame to be elevated while the tractor is being moved from location to location.

U.S. Pat. No. 2,146,101, issued Feb. 7, 1939 to Frederick W. Weber, provides a trench tamper for use with a motorized vehicle employing a drum from which a number of legs extend radially. The drum is pivotally joined by a tow bar to a tube laterally extending from said vehicle.

U.S. Pat. No. 4,021,725, issued May 3, 1977 to James L. Kirkland, discloses a mobile mine detection system which utilizes a magnetic sensor array mounted upon a boom extending from a motorized vehicle. Electrical signals generated by the array are converted into a distinctive color output on a cathode ray tube display mounted within the vehicle for inspection purposes.

U.S. Pat. No. 4,467,694, issued Aug. 28, 1984 to Max Azulai et al, discloses a mine clearing apparatus having two widely spaced plow blades oriented so as to form a "V" and a frame mountable to a vehicle for selectable positioning in a raised or lowered orientation.

U.S. Pat. No. 4,491,053, issued Jan. 1, 1985 to Simcha Bar-Nefy et al, provides a minefield clearing apparatus mountable upon a vehicle having an apparatus for automatically raising the plow from its lowered orientation to its raised orientation in response to the backwards motion of said vehicle. Continued rotation of the mounting apparatus raises the plow until it engages a retaining hook where it is stationarily held.

U.S. Pat. No. 4,552,053, issued Nov. 12, 1985 to Simcha Bar-Nefy et al, shows a minefield clearing apparatus mountable upon a vehicle having two widely spaced plow blades oriented so as to form a "V", such blades have two plow sections. An upper section moves soil, sliced by the teeth of the lower section, laterally.

U.S. Pat. No. 4,590,844, issued May 27, 1986 to Simcha Bar-Nefy et al, discloses a minefield clearing apparatus for attachment to a vehicle having two widely spaced plow blades so as to form a "V" which may be raised or lowered automatically from inside the vehicle.

U.S. Pat. No. 4,593,766, issued Jun. 10, 1986 to Gordon G. Gossard, teaches the use of an electromagnet for the removal of spent projectiles from previous target runs directed toward the strafing pit area of an Air Force gunnery range. In the preferred embodiment, he electromagnet is suspended from chains ahead of the blade of a bulldozer.

U.S. Pat. No. 4,690,030, issued Sep. 1, 1987 to Simcha Bar-Nefy et al, provides a minefield clearing apparatus for attachment to a vehicle having two widely spaced plow blades oriented so as to form a "V" and being a continuation-in-part of U.S. Pat. No. 4,590,844.

U.S. Pat. No. 4,840,105, issued Jun. 20, 1989 to Uri Ladan et al, discloses a minefield clearing apparatus having an element for exploding magnetic mines suspended between mine rakes. The element, comprising a permanent magnet, is arranged for driven engagement with the ground surface whereby motion of the supporting vehicle imparts rotational movement thereto.

None of the above inventions and patents, taken either singly or in combination, is seen to describe the instant minefield clearing apparatus as claimed.

SUMMARY OF THE INVENTION

The present inventive minefield clearing apparatus seeks to overcome the difficulties and disadvantages possessed by the aforementioned prior art devices. In this regard, the instant apparatus utilizes a systems approach to locating, neutralizing, collecting, and discharging battlefield debris in the form of mines, projectiles, and small pieces of shrapnel. In this fashion, components of the instant apparatus are able to operate independently when necessary. Further, "quick release" features incorporated into the mounting and other connective brackets permit the ready replacement or removal of each of said components for various purposes. Therefore, a damaged part can be removed, if necessary, in the field and replaced with a spare which may be kept on hand with a minimum of time.

Accordingly, it is a principal object of the invention to provide an apparatus capable of collecting, temporarily storing, and discharging battlefield debris in a controlled manner.

It is an additional object of the present invention to provide a battlefield debris clearing apparatus having means for selectively detonating unexploded battlefield ordinance.

It is a further object of the present invention to provide a battlefield debris clearing apparatus with means for directing high velocity gas toward the ground surface to winnow soil material from battlefield debris of greater density.

It is another object of the invention to provide a battlefield debris clearing apparatus utilizing magnets for collecting ferrous battlefield debris.

It is an additional object of the present invention to provide a battlefield debris collecting apparatus having a magnetic sensor array for detecting deeply buried mines and means responsive to the voltage output from said array for marking the location of the detected mine upon the ground surface.

It is another object of the invention to provide a means for supporting a battlefield debris clearing apparatus upon a vehicle in such a manner as to permit the ground contacting portions thereof to be elevated while the vehicle is in motion from place to place without using the apparatus.

It is still another object of the invention to provide a simple and efficient means for facilitating the raising and lowering of the ground contacting portions of a battlefield debris clearing apparatus.

It is an object of the invention to provide improved elements and arrangements thereof in a battlefield debris clearing apparatus for the purposes described which is relatively inexpensive, dependable and fully effective in accomplishing its intended purposes.

These and other objects of the present inventive minefield clearing apparatus will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
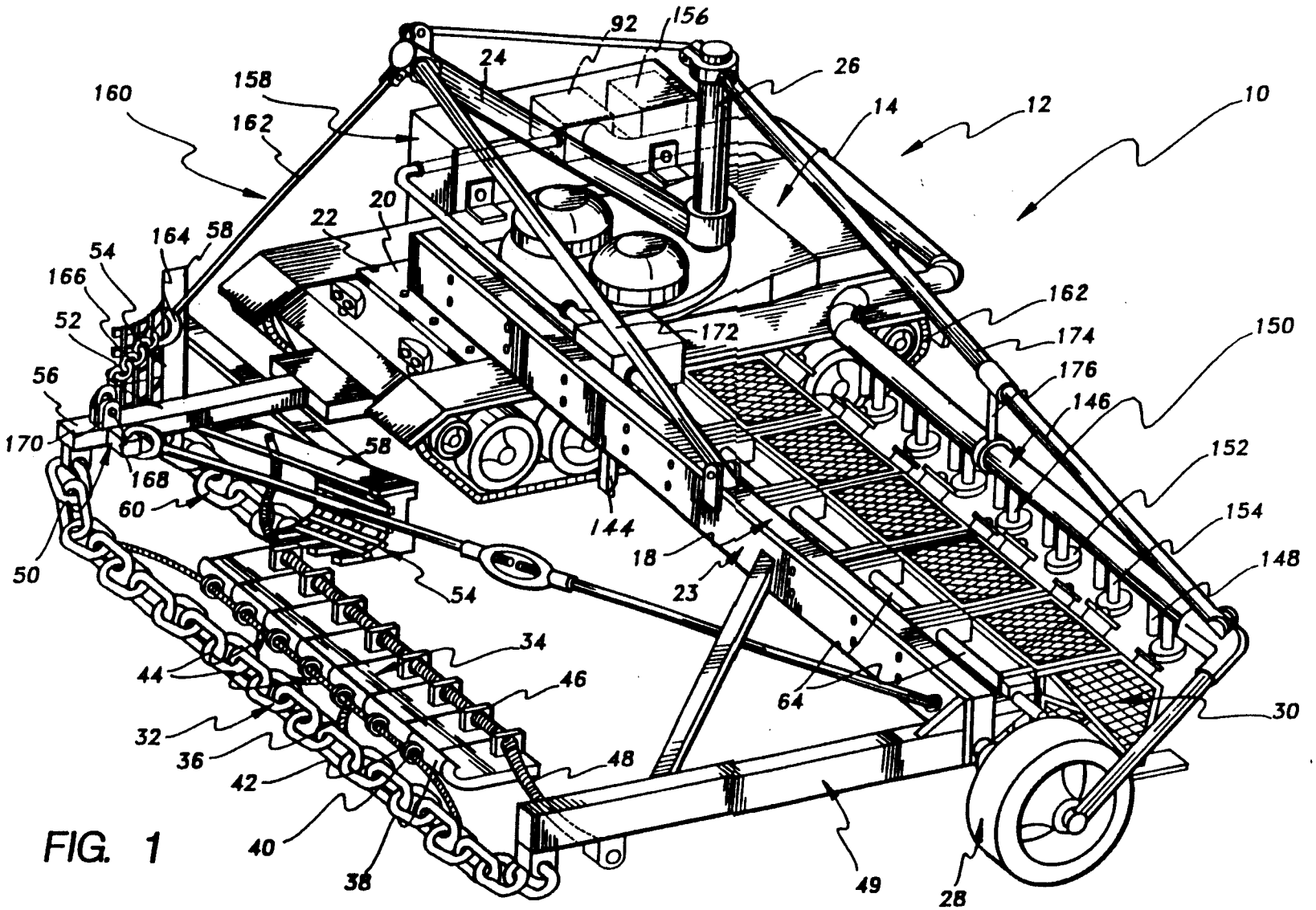
FIG. 1 is an environmental perspective view of a battlefield debris clearing apparatus in accordance with this invention joined to a tractive vehicle.

Referring now to the drawings, a battlefield debris clearing apparatus 10 in accordance with this invention is shown by way of example only. By referring to FIG. 1, it will be seen that 12 represents an armored vehicle provided with a tank-like hull or body 14 and rotatable treads 16 for locomotion. Rigidly mounted onto tank body 14 is apparatus 10. Rigidity of mounting is provided primarily by the tight engagement of horizontal girder or beam 18, adapted for lateral attachment to vehicle 12, and the top of vehicle 12 by mounting plate 20 fixedly mounted onto tank body 14. Mounting plate 20 is urged against body 14, for example, by screws 22 which may be easily accessed for quick release of apparatus 10 from body 14. As can be seen in the illustration, beam 18, of hollow box construction, provides the primary support for apparatus 10 and may be further reinforced and armored with a metal plate 23 fastened to its leading edge. The beam 18 carries the weight of the ground contacting portions of the instant apparatus. Boom 24 joined to, and extending upward at an angle from, the base of fixed vertical mast 26 lends an additional component of support to beam 18 in a manner described in greater detail below. A large diameter wheel 28, preferably of all metal construction, is rotatably joined to the distal end of beam 18. Contacting the ground surface, wheel 28 reduces the moment about the center of gravity of vehicle 12 due to the large mass of apparatus 10 positioned laterally therefrom. In this manner, the tendency of vehicle 12 to otherwise rotate or roll toward the lateral components of apparatus 10 is eliminated and the distribution of load upon vehicle treads 16 is retained in substantial equivalence.

Suspended before beam 18 is a chain 32 for causing the destruction by detonation of unexploded battlefield ordnance at a safe distance from vehicle 12. Preferably, chain 32 is constructed of massive and high strength materials such as medium weight anchor chain currently utilized by the marine shipping industry. It is anticipated that during use such materials, even with their well known qualities for durability, may become damaged thereby requiring replacement. For this reason a spare chain may be transported upon vehicle 12 for rapid replacement. Repair of damaged links may be accomplished later at a supporting maintenance facility at a convenient time. Those skilled in the art will realize that heavy gauge wire rope may be readily substituted for chain 32. Wire rope having a minimum diameter ranging from one half to five eighths of an inch (approximately one and a half centimeters) and having loops formed at each end thereof to facilitate attachment to apparatus 10 may be readily employed for the purposes hereinbefore described.

Anti-personnel mine clearing shoes 34, attached to chain 32 by wire rope 36, comprise rectangular metallic sheets having their forward facing ends 38 curved upward in the form of an arc thereby permitting shoes 24 to ride over the ground surface with minimal frictional resistance. Rope 36 is threaded through holes 40 in flanges 42 of each shoe 34 and the two ends of rope 36 are joined to the ends of chain 32. Although any machining technique may be utilized to create hole 40, the preferred method of formation involves cutting with a welding torch. Additional short lengths of wire rope 44 connect rope 36 to chain 32 and retain rope 36 in a relationship substantially parallel to that of chain 32. Each shoe 34 has upon its top surface an alignment tube 46. Tubes 46 serve to join an additional length of wire rope 48, connecting chain retaining arm 49 with the nearest of the plow retaining arms 58, to each of shoes 34, rope 48 retaining shoes 34 in proper alignment and further preventing their upset upon the detonation of a nearby mine. Rope 48 is provided with such a length so as to permit nearly unrestricted individual movement of the rear ends of shoes 34 relative to one another. A break in any of ropes 36, 44, and 48 may be repaired on site by splicing, but extra lengths of wire rope may be retained upon vehicle 12 for rapid replacement and quick deployment. From the foregoing, it should be appreciated that shoes 34 will conform to variations in terrain while moving over the ground surface, the bottom surfaces of thereof remaining in contact with the ground under the most extreme conditions. As certain types of highly destructive anti-tank mines usually require greater pressures applied to the ground surface for detonation than their less powerful anti-personnel counterparts, shoes 34 may be weighted or otherwise sized to exert upon the ground pressures within a desired range. In this manner, highly destructive anti-tank mines may be retained within the ground for later removal while less damaging explosive devices may be harmlessly detonated.

A mine rake assembly 50 is positioned forward of vehicle body 14. Assembly 50 comprises a rigid structural frame 52 pivotally attached to the front of vehicle body 14 and two plow faces 54 depending from frame 52 and before vehicle treads 16. Frame 50 includes a bowsprit 56, the front end of which capable of being raised or lowered in a vertically oriented plane, projecting forward from vehicle body 16 and lateral plow retaining arms 58 extending therefrom. Plow faces 54 are of a construction substantially similar to the plow faces described in the applicant's issued U.S. Pat. No. 5,189,243, hereby incorporated by reference. Plow faces 54 protect treads 16 from mines positioned within their path. Plow faces 54 and frame 52 are preferably constructed of high strength ferrous materials permitting such to withstand the forces generated as plow faces 54 move through the ground surface at a depth of approximately six inches (fifteen centimeters). Thick-walled square metal tubing is employed in the construction of frame 52. Bar stock and rolled sheet material, likewise, are used in the construction of plow faces 54. Mounted between plow faces 54, chain 60 provides for the engagement and detonation of mines potentially damaging the underside of vehicle body 14.

Figure 2:
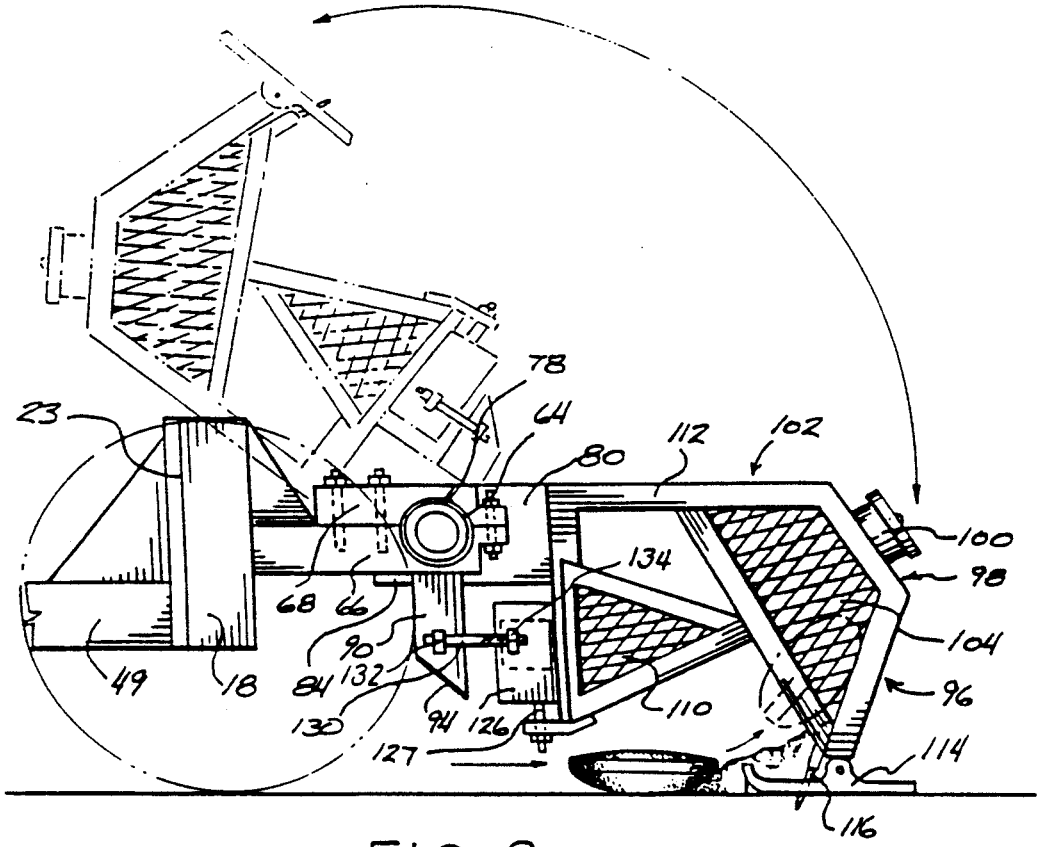
FIG. 2 is a side view of a debris collecting basket, dashed lines showing the basket at its rotated position.
Figure 3:
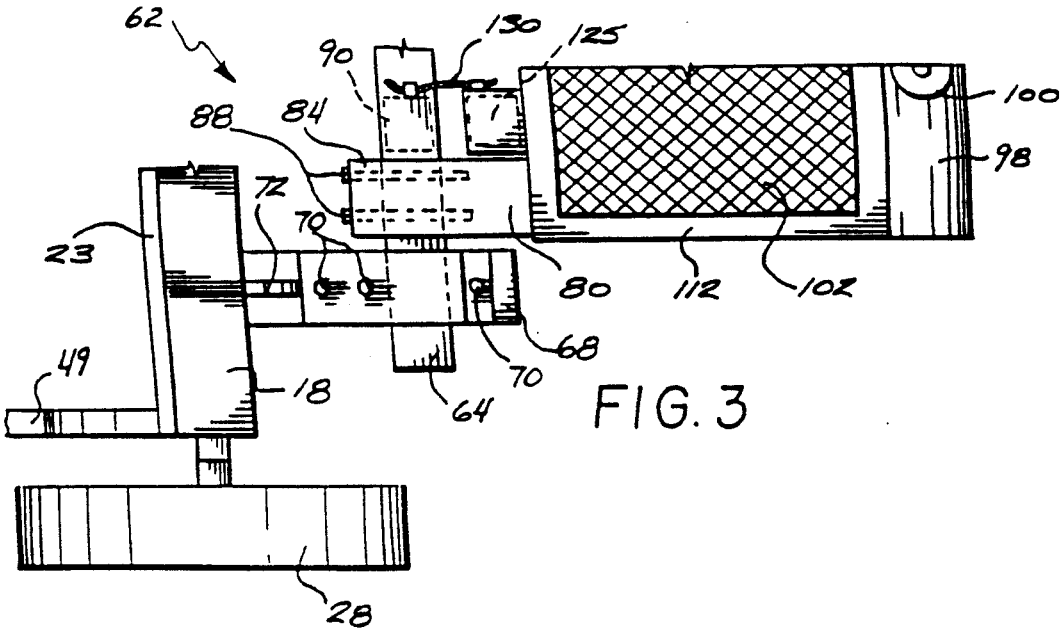
FIG. 3 is a plan view of the debris collecting basket of FIG. 2 having a portion broken away.

Rotatably joined to beam 18 by a plurality of interface assemblies 62 spaced at intervals along the length of beam 18, thick-walled metal tube 64 serves as a pivot arm for collecting baskets 30. As may be seen in FIGS. 2 and 3, each interface assembly 62 comprises a bottom bracket 66 extending horizontally from, and rigidly joined to, beam 18 and a top bracket 68 resting upon, and secured to, bottom bracket 66, for example, by threaded fasteners 70. Further reinforcement of the connection between bracket 66 and beam 18 is provided by triangular gussets 72 and 74. With one side thereof attached to beam 18, gusset 72 extends to the upper surface of bracket 66. Similarly, gusset 74 connects the lower surface of bracket 66 to beam 18. Each of brackets 66 and 68 has a semicircular cutout 76 such that, when joined together, a passage 78 with a diameter sufficient to permit the rotation of tube 64 therein is established. Bearings (not shown) may be fitted within passage 78 thereby reducing the work required to rotate tube 64.

Each interface assembly 62 also includes means to pivotally join baskets 30 to tube 64. Reaching from the front portion of each basket 30 is basket arm 80 having a semicircular cutout 82 for engaging tube 64. Clamp 84 having a semicircular cutout 86 substantially similar in size to cutout 82 is securely fastened by bolts 88 to arm 80 thereby joining basket 30 to tube 64. Bearings (not shown) may be fitted inside each of cutouts 82 and 86 to reduce frictional forces generated by rotation upon tube 64. Each basket 30 is free to move independently thereby permitting a swath having a width substantially equal to the that of the row of baskets 30 to be thoroughly cleansed of battlefield debris regardless of the evenness of terrain.

Tube 64 not only serves as a pivot for collecting baskets 30, but also comprises a portion of a ground surface scrubber system utilizing directed high velocity gas streams. Tube 64 has a plurality of nozzles 90 extending downwardly therefrom, one nozzle 90 centrally positioned before each basket 30. Each nozzle 90 is in fluid communication with the interior of tube 64 supplied with a compressed gas or gas mixture, preferably air, from a suitably sized compressor 92 mounted upon vehicle body 14. Ports 94 defined by an opening or orifice at the distal ends of each nozzle 90 direct the flow of compressed gas toward the ground surface in such a manner so as to winnow unconsolidated soil material from metal and plastic battlefield debris of greater specific gravity. In this fashion, large volumes of undesirable debris may be readily exposed for collection in baskets 30 as covering sand and soil are removed.

This winnowing action further reduces the volume of earthen spoil material that must be filtered through each basket 30.

The length as well as the cross-sectional area of each nozzle 90 may be varied to optimize the movement of soil material in accordance with its physical properties. For instance, large volumes of relatively unconsolidated material can be adequately moved from the paths of the trailing baskets 30 with a relatively diffuse stream of gas as supplied by a large diameter nozzle and port. More consolidated or damp soil materials, on the other hand, can only be moved with a directed, high velocity flow. Well known fluid dynamics principals dictate that velocity increase can be generated by reducing the cross sectional area of the interiors of nozzles 90 or ports 94 subject to gas flow, assuming that the available volume of compressed gas remains constant. Likewise, a velocity increase may also be generated by increasing the volume of gas delivered through a nozzles 90 or ports 94 of constant diameter. Orifice plates or other flow restrictors (not shown) may be inserted into nozzles 90 to regulate gas flow therefrom. Such restrictors, increasing in size in a downstream direction, would permit substantially equivalent gas flow through nozzles 90 without varying the configuration thereof. Further, such mechanically adjustable restrictors in the form of valves would permit gas flow to be remotely regulated.

Figure 4:
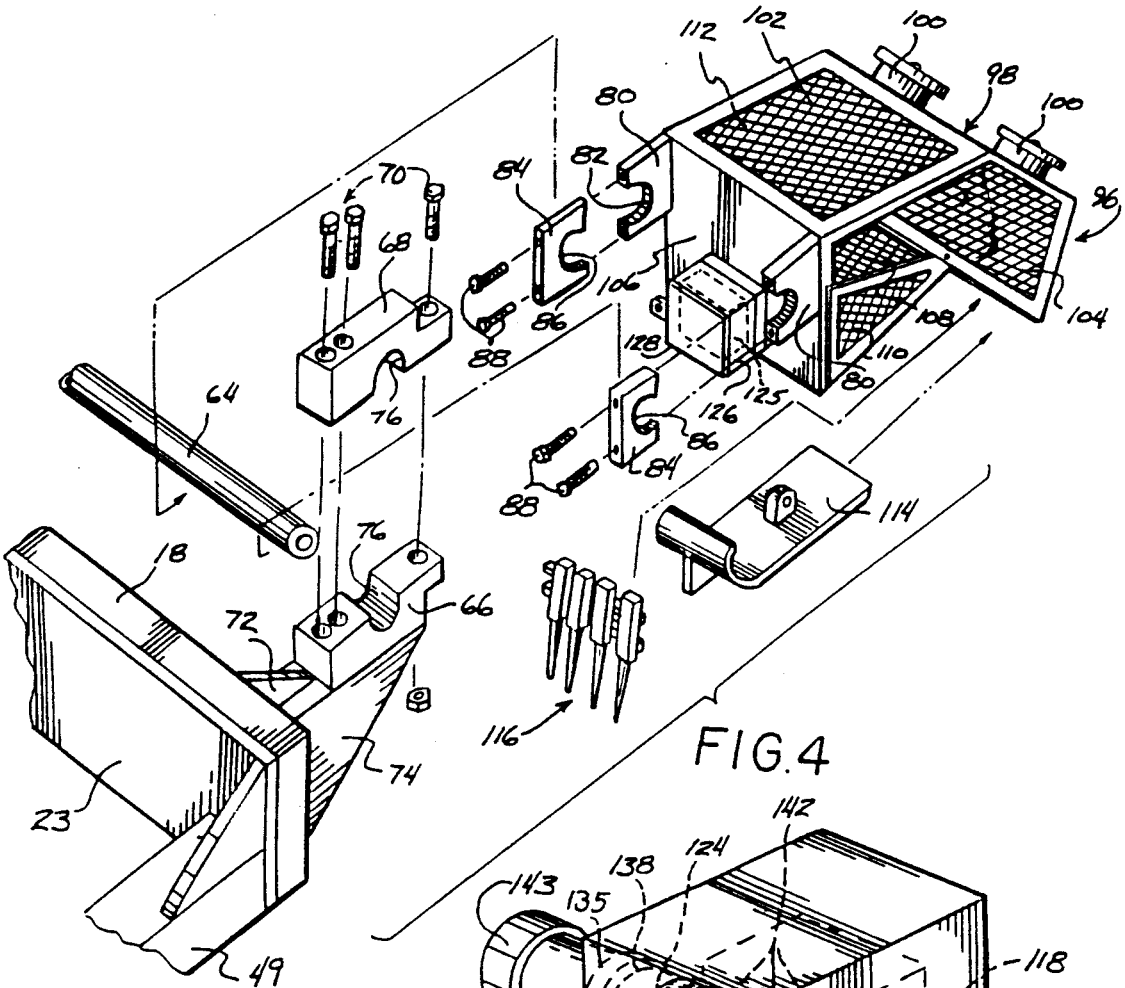
FIG. 4 is a perspective and exploded view of the basket of FIG. 2 showing mounting details thereof.

In the preferred embodiment, five debris collecting baskets 30 are pivotally mounted in side-by-side fashion upon tube 64. As may be viewed in FIG. 4, each basket 30 comprises a wire mesh container defined by an assembly comprising: a rectangular back panel 96 disposed to first receive battlefield debris from the ground surface; a rectangular median panel 98 of metal plate material joined to the upper edge of back panel 96 and upon which are mounted a plurality of magnets 100; a rectangular top panel 102 joined to the upper edge of median panel 98 which, when in normal use, is disposed in a substantially horizontal orientation parallel to the ground surface; two side panels 104 joined to the opposed lateral edges of panels 96, 98, and 102 for retaining collected battlefield debris upon back panel 96, each side panel 104 having an irregular quadrilateral configuration; a rectangular front panel 106 of metal plate material joined to the forward edge of top panel 102 for shielding basket 30 from blast damage; rectangular bottom panel 108 engaged with the bottom edge of front panel 106 and hingedly joined to side panels 104 for receiving and retaining collected battlefield debris; and second side panels 110 of triangular configuration joined to front panel 106, bottom panel 108, and first side panel 104. As may be seen in the figures, the assembly of back panel 96, side panels 104, and bottom panel 108 define an upwardly sloping opening adapted to lift and collect battlefield debris from the ground surface. Preferably, panels 96, 102, 104, 108, and 110 are comprised of an open wire mesh or screen material of expanded metal, lattice, or web construction. Openings in the mesh have an effective diameter of approximately three fourths of an inch (two centimeters) to permit the passage of earthen spoil material and diminutive battlefield debris fragments of non-metallic origin therethrough. Objects having a size greater than the effective diameter of the openings within the screen material will be retained within basket 30. To facilitate and reinforce the joining of the panels comprising basket 30, L-shaped angle metal brackets, such as at 112, are provided to which each of said panels may be fastened by suitable means.

To facilitate the removal of debris from the field, projecting from the lower edge of back panel 96 are a plurality of spaced teeth or tines 116 of spring metal which rake the ground surface to a predetermined depth. Thus, when apparatus 10 is passed over the ground surface, tines 116 move near-surface battlefield debris upwardly and into contact with back panel 96. Preferably, tines 116 have sufficient rigidity to be retained within the ground surface while the apparatus is in use. Establishing the depth of insertion of tines 116 into the ground surface are skid shoes 114 disposed beneath, and pivotally attached to, baskets 30. Each shoe 114 holds a single basket 30 at a set distance above the ground surface and when used directs basket 30 in an upward or downward direction as ground surface contour varies. Tine spacing is approximately equal to the effective diameter of the grid openings in the basket panels.

Ferrous battlefield debris uncovered by the action of gas directed from ports 94 and brought into basket 30 by tines 116 will be temporarily trapped therein by magnets 100. One or more magnets 100 are affixed to the median panel 98 of each basket 30. Magnets 100 do not extend through panel 98 into the interiors of baskets 30 but remain shielded upon the exterior surface thereof. In the preferred embodiment, two electromagnets, mounted in tandem, are utilized. Nevertheless, it is believed that permanent magnets of Alnico, ceramic, or Rare Earth Cobalt composition may be effectively substituted for magnets of electromagnetic type with equal facility. Permanent magnet compositions are known to offer a high degree of stability and strength, an extreme resistance to demagnetization, and a high energy output. Magnets 100, appropriately sized, of permanent or electromagnetic type having energy densities of 27 to 35 million gauss oersteds, would be more than sufficient to hold ferrous materials weighing several pounds or kilograms thereto and within basket 30. When electromagnets are used within apparatus 10, such may be neutralized or activated by a switch (not shown) within the electrical circuit supplying magnets 100 with power. By opening or closing the switch, magnets 100 may be activated or deactivated. If permanent magnets are employed within apparatus 10, mechanical rather than electrical means for activation must be utilized. In their normal operating position, magnets 100 of permanent type would ride directly upon median panel 98. Debris retained within each basket 30 by magnets 100 would tend to accumulate upon the inner wall of panel 98 proximate said magnets 100. To discharge the debris, then, magnets 100 of permanent type would be shifted or moved a set distance from panel 98 thereby reducing magnetic field density at panel 98 to the point where gravity will effectuate the removal of debris therefrom. Means for moving the permanent type magnets (not shown) could include appropriately positioned hydraulic cylinders or motor operated gearing.

Baskets 30 may be utilized to store large quantities of battlefield debris collected from the ground surface prior to ultimate disposal therefrom. Debris storage within baskets 30 is accomplished by activation of drive motor 118, shown in FIG. 5, securely joined to vehicle 12 which, in turn, rotates a worm gear 119 having a threaded shaft 120 and a wheel 122 having teeth 124 that mesh into shaft 120. Wheel 122, circumferentially joined to tube 64, imparts a torque to tube 64 causing it to rotate approximately 120° bringing baskets 30 upward from the ground surface therewith to the position shown by dashed lines in FIG. 2. Nozzles 90, disposed from tube 64, impart the motive force for the rotation of baskets 30, engaging such upon their box-like winch compartments 126 joined to the respective front panels 106 thereof. At the front of each winch compartment 126, constructed of reinforced sheet metal, is joined a high density rubber pad 128 to reduce the noise upon contact with its respective nozzle 90. To prevent the over-rotation of each basket 30 once the center of gravity passes vertical, a flexible retaining cord 130 links each nozzle 90 with its respective basket 30. The play or movement of basket 30 relative to nozzle 90 is limited by the length of cord 130 determined largely by conditions of use. Rugged, uneven terrain would mandate a somewhat longer cord 130 than would relatively smooth surface topography to provide baskets 30 with a greater range of motion. When assembled, one end of cord 130 fastens to nozzle 90 at perforated retainer 132 and the other fastens to basket 30 at a similar perforated retainer 134 joined to the side of winch compartment 126 opposite retainer 132. Once rotation of tube 64 and attached baskets 30 is complete, in the preferred embodiment, current flow to magnets 100 is switched off thereby permitting ferrous battlefield debris held in place by magnets 100 to fall onto top panel 102 and front panel 106 now comprising the lowermost surfaces of basket 30. When baskets 30 are returned to their original orientation proximate the ground, by activation of worm gear 119 in a sense opposite that necessary to bring said baskets to their rotated orientation, battlefield debris held between panels 102 and 106 will saltate into a compartment defined by front panel 106, bottom panel 108, and side panels 110. Once in the compartment, debris may be held until its release therefrom is desired. Unintended discharge of debris from within the compartment is prevented by the substantial vertical elevation of side panels 110 relative to the median size of the collected debris as well as the steeply sloping orientation of bottom panel 108 when basket 30 is in its lowered debris clearing position.

The compartment may be readily cleared of collected debris. In this regard, winch motor 125 housed within winch compartment 126 is activated thereby creating slack in winch cable 127. This slack permits bottom panel 108 to swing downwardly upon its pivotal attachments to side panels 104. Once gravity effectuates the removal of debris from the compartment, winch motor 125 may be activated in the opposite sense, slack being taken out of winch cable 127 and bottom panel 108 returned to its original orientation against the bottom edge of front panel 106.

Figure 5:
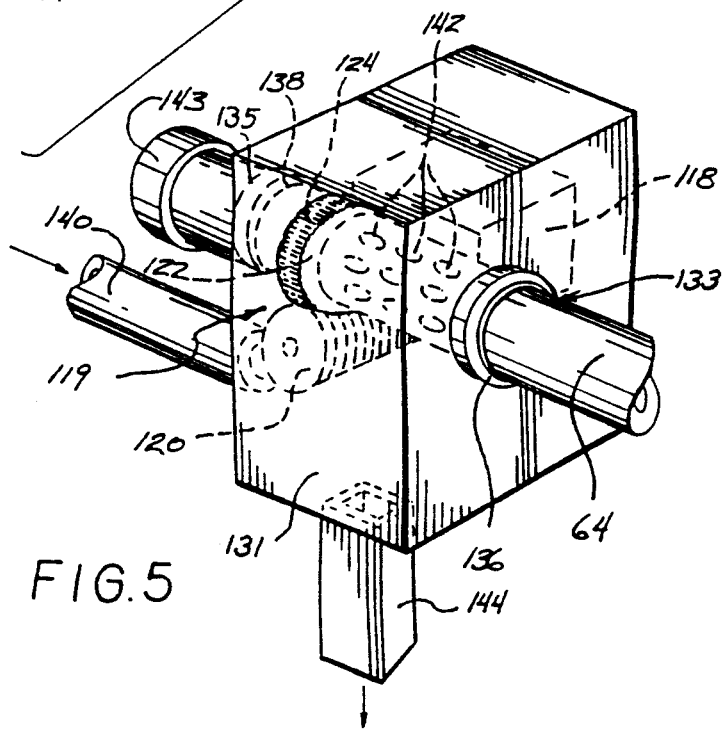
FIG. 5 is an perspective view of the worm gear assembly for rotating the tube and adjoining debris collecting baskets.

As seen in FIG. 5, drive motor 118 and worm gear mechanism 119 are fitted within an air-tight housing 131. Housing 131, comprising a generally rectangular box, protects the elements within from blowing soil material and minute battlefield debris fragments. Housing 130 has two circular bores 133 and 135 in opposing sides thereof the centers of which are aligned upon an axis passing centrally through the center of tube 64. Bores 133 and 135 permit tube 64 to pass through housing 131 and establish the positioning of wheel 122 relative to threaded shaft 120. Airtight bearings 136 and 138 having a suitable internal packing material are fitted within bores 133 and 135 respectively allow tube 64 to rotate with minimal frictional resistance within housing 131. A sealed hatch in one of the housing walls (not shown) allows access to the interior of housing 131 for inspection and maintenance purposes.

Compressed gas is supplied to tube 64 and attached nozzles 90 through housing 131. A compressed gas supply line 140 joined to housing 131 and in fluid communication therewith transmits compressed gas into housing 131 from compressor 92. Gas seeking a low pressure outlet from housing 131 enters ports 142 provided about the circumference of tube 64 and flows toward nozzles 90 for discharge toward the ground surface. To prevent the escape of gas from tube 64 anywhere but from nozzles 64 joined thereto, caps, as at 143, seal each end thereof. A housing nozzle 144 joined to the bottom surface of housing 131 and in fluid communication with the interior thereof directs compressed gas toward the ground surface in a manner similar to that of nozzles 90; however, nozzle 144, instead of directing flow vertically downward, directs its flow toward vehicle treads 16 thereby moving debris proximate thereto in a direction toward baskets 30 for collection purposes. An orifice plate or valve (not shown) may be inserted within or joined to nozzle 144 in order to regulate gas flow therefrom.

The ground surface scrubber system comprises a second tube 146 located behind collection baskets 30 for the delivery of compressed gas from compressor 92 to the ground surface and is seen in FIG. 1. Extending downwardly from tube 146 and in fluid communication with the interior thereof are nozzles 148 for directing gas flow. From this location compressed gas may be directed at the ground just cleared by baskets 30 further winnowing loose soil material from battlefield debris materials of greater density which were not retained within baskets 30. Crews following apparatus 10 at a short distance may easily locate remaining exposed debris and remove such from the field if desired. Generally, the volumes and velocities of gas delivered from tube 146 are less than those relative to those of tube 64. As the ground has already been scrubbed by gas delivered from forwardly oriented nozzles 90 and raked to depth by tines 116, at most only a small amount of shallowly buried debris will remain for cleanup. This remaining debris can generally be revealed by a light blow of directed air from nozzles 148 capable of removing approximately one fourth of an inch (one half of a centimeter) of soil material.

Joined to air delivery tube 146 is a magnetic sensor array 150 for the detection of deeply buried objects not encountered or collected by baskets 30. Sensor array 150 comprises an array made up of a plurality of individual total field sensors, as at 152, arranged in a row across the path of travel of apparatus 10 and each connected to a suitable voltage source (not shown). Each field sensor is joined to tube 146 by a hollow sensor support bracket 154. The sensors in this embodiment are of the type known as cesium vapor magnetometers which are believed to be commercially available from several domestic sources. Such sensors are capable of providing an analog voltage output indicating the presence of deeply buried metallic devices. Upon detecting a metallic object of a size sufficient to cause a voltage output of sufficient strength, as may be present into the sensor circuit, a switch (not shown) will automatically be activated, opening a valve (not shown) and depositing a small quantity of brightly colored granular material or liquid contained in a reservoir (not shown) within sensor support bracket 154 onto the ground surface thereby marking the location of the potential mine for further investigation.

Mounted on the opposite side of vehicle 12 from the ordnance collection baskets 30 are generator 156 for supplying a suitable voltage source to operate motors 125 and magnetic field sensors 152. Adjacent to generator 156 is air compressor 92 for supplying tubes 64 and 146 with sufficient quantities of compressed air to move soil material as described above. Generator 156 and compressor 92 are housed in a protective box-like shield 158 which prevents soil material suspended in the air and exploding ordnance from damaging or fouling working parts thereof. The location of generator 156 and compressor 92 upon the side of the vehicle body 14 not only protects such from ordnance explosions but counterbalances the weight of the collection system eliminating potential damage to the vehicle drive train caused by an imbalance.

Reinforcement for apparatus 10 is provided by cables extending from mast 26 and boom 24 to other critical locations. A first connector 160 extends from the forward end of boom 26 downwardly to the forward end of bowsprit 56. Connector 160 comprises a wire rope 162 having joined to its lower end a J-shaped hook 164 and a linked chain 166 for hooked engagement with said hook 164. A link in the lower end of chain 166 is retained in engagement with bowsprit 56 by pin 168 inserted through the link and U-shaped bracket 170 affixed to bowsprit 56. To remove plow faces 54 from engagement with the ground surface, the front of bowsprit 56 must be elevated using a mechanism external of apparatus 10 (not shown) and J-shaped hook 164 placed in engagement with chain 166 such that no slack exists within said chain. Once engaged, the lifting force initially supplied to the front of bowsprit 56 may be eliminated, the shortened connector 160 now holding plow faces 54 above the ground surface. A second connector 172 of wire rope material joins the forward end of boom 56 with beam 18. Connector 172 transmits a portion of the vertical load component from beam 18 to boom 56 and therefore to the vehicle 12. A third connector 174 of wire rope material joins the top of mast 26 with the rearward air delivery tube 146. Connector 174 transmits a portion of the vertical load component from tube 146 to boom 56 and hence to vehicle 12. A tube hanger 176 joins the central portion of air delivery tube 146 to connector 174 and provides additional support thereto.

It is to be understood that the present minefield clearing apparatus is not limited to the embodiments described above, but encompasses any and all embodiments within the scope of the following claims.

I claim:

1. A battlefield debris clearing apparatus for attachment to a vehicle, comprising:

a horizontal beam having a planar mounting bracket joined to one of its ends for rigid, lateral attachment to a vehicle; and a basket pivotably attached to said beam, said basket comprises an assembly of planar panels of open lattice construction arranged so as to form a container for the selective retention of debris having a size greater than that of the lattice opening.

2. The battlefield debris clearing apparatus according to claim 1 wherein said basket comprises:

a plurality of tines downwardly disposed from said opening for raking the ground surface.

3. The battlefield debris clearing apparatus according to claim 1 further comprising:

a skid shoe pivotally joined to the bottom of said basket for directing the upward and downward movement of said basket in accordance with ground surface contour.

4. The battlefield debris clearing apparatus according to claim 1 further comprising: means to mechanically rotate said basket about an axis substantially parallel to the longitudinal axis of said beam.

5. The battlefield debris clearing apparatus of claim 1 further including:

means positioned in front of said basket opening for delivering a high velocity gas stream to the ground surface whereby unconsolidated soil material may be winnowed from battlefield debris of greater specific gravity.

6. The battlefield debris clearing apparatus according to claim 1 further including:

a magnetic sensor array positioned behind said basket for the detection of objects buried below the ground surface.

7. The battlefield debris clearing apparatus according to claim 1 further including:

means positioned behind said basket for delivering a high velocity gas stream to the ground surface whereby unconsolidated soil material may be winnowed from battlefield debris of greater specific gravity.

8. The battlefield debris clearing apparatus according to claim 1 further including:

a first chain positioned in front of said basket and disposed upon the ground surface for the detonation of unexploded battlefield ordnance at a safe distance from the vehicle.

9. The battlefield debris clearing apparatus according to claim 8 further including:

a plurality of anti-personnel mine clearing shoes attached to said chain and disposed upon the ground surface for the detonation of unexploded battlefield ordnance at a safe distance from the vehicle.

10. The battlefield debris clearing apparatus according to claim 1 further comprising:

a magnet joined to said basket for retaining ferrous battlefield debris therein.

11. The battlefield debris clearing apparatus according to claim 10 wherein said magnet further comprises an electromagnet.

12. The battlefield debris clearing apparatus according to claim 6 wherein said magnet is of an alnico composition.

13. The battlefield debris clearing apparatus according to claim 1 further including:

a rigid frame mountable onto a vehicle for selectable positioning in a raised or lowered orientation; and plow means joined to said frame for raising and shunting aside objects buried beneath the ground surface.

14. The battlefield debris clearing apparatus according to claim 13 wherein said plow means further includes:

a first and a second plow face mounted upon said frame adjacent the right and left front sides of the vehicle.

15. The battlefield debris clearing apparatus according to claim 14 further including:

a second chain joining said first and second plow faces and disposed upon the ground for the destruction of mines potentially damaging to the underside of the vehicle.

16. A battlefield debris clearing apparatus for attachment to a vehicle, comprising:

a horizontal beam having a planar mounting bracket joined to one of its ends for rigid, lateral attachment to a vehicle;

a plurality of baskets pivotably attached to said beam and laterally positioned from one another along the lengths of said beam, each of said baskets comprises an assembly of planar panels of open lattice construction arranged so as to form a container for the selective retention of debris having a size greater than that of the lattice opening; and, means to mechanically rotate said baskets about an axis substantially parallel to the longitudinal axis of said beam.

17. The battlefield debris clearing apparatus according to claim 16 further comprising:

a rigid frame mountable onto a vehicle for selectable positioning in a raised or lowered orientation; and plow means joined to said frame for raising and shunting aside objects buried beneath the ground surface.

18. The battlefield debris clearing apparatus according to claim 17 further comprising:

a magnetic sensor array positioned behind said baskets for the detection of objects buried below the ground surface.

19. A battlefield debris clearing apparatus for attachment to a vehicle, comprising:

a horizontal beam having a planar mounting bracket joined to one of its ends for rigid, lateral attachment to a vehicle;

a plurality of baskets pivotably attached to said beam and laterally positioned from one another along the lengths of said beam, each of said baskets comprises an assembly of planar panels of open lattice construction arranged so as to form a container for the selective retention of debris having a size greater than that of the lattice opening;

means to mechanically rotate said baskets about an axis substantially parallel to the longitudinal axis of said beam;

a magnet joined to each basket for retaining ferrous battlefield debris within each said basket;

means positioned in front of each said basket for delivering a high velocity gas stream to the ground surface such that unconsolidated soil material may be winnowed from battlefield debris of greater specific gravity;

a magnetic sensor array positioned behind said baskets for the detection of objects buried below the ground surface;

means positioned behind said baskets such that unconsolidated soil material may be winnowed from battlefield debris of greater specific gravity;

a first chain positioned in front of said baskets and disposed upon the ground surface for the detonation of unexploded battlefield ordnance at a safe distance from the vehicle; and a plurality of anti-personnel mine clearing shoes attached to said first chain and disposed upon the ground surface for the detonation of unexploded battlefield ordnance at a safe distance from the vehicle.

* * * * *